US007716754B1

(12) United States Patent
Ross

(10) Patent No.: US 7,716,754 B1
(45) Date of Patent: May 18, 2010

(54) SKI HELMET WITH ADJUSTABLE FACE SHIELD

(76) Inventor: William Ross, 368 Citadel Ave., Ventura, CA (US) 93003

( * ) Notice: Subject to any disclaimer, the term of this patent is extended or adjusted under 35 U.S.C. 154(b) by 308 days.

(21) Appl. No.: 11/749,334

(22) Filed: May 16, 2007

Related U.S. Application Data

(60) Provisional application No. 60/908,224, filed on Mar. 27, 2007.

(51) Int. Cl.
*A42B 1/08* (2006.01)

(52) U.S. Cl. ..... 2/424; 2/425; 2/410

(58) Field of Classification Search ..... 2/424, 2/425, 6.5, 15
See application file for complete search history.

(56) References Cited

U.S. PATENT DOCUMENTS

| | | | | | |
|---|---|---|---|---|---|
| 3,383,706 | A | * | 5/1968 | Lobelle | 2/6.5 |
| 3,491,371 | A | * | 1/1970 | Deangelis | 2/410 |
| 3,721,994 | A | * | 3/1973 | DeSimone et al. | 2/410 |
| 3,806,951 | A | | 4/1974 | Halteman | |
| 4,054,953 | A | * | 10/1977 | De Barsy | 2/414 |
| 4,117,553 | A | | 10/1978 | Bay | |
| 4,287,615 | A | * | 9/1981 | Morin | 2/424 |
| 4,579,099 | A | * | 4/1986 | Kishida et al. | 123/684 |
| 4,612,675 | A | | 9/1986 | Broersma | |
| 5,093,937 | A | * | 3/1992 | Kamata | 2/424 |
| 5,157,794 | A | * | 10/1992 | Kamata | 2/424 |
| D331,474 | S | | 12/1992 | Lehtonen | |
| 5,329,642 | A | * | 7/1994 | Dampney | 2/424 |
| 5,394,566 | A | * | 3/1995 | Hong | 2/424 |
| 5,469,584 | A | * | 11/1995 | Casartelli | 2/422 |
| 5,647,060 | A | * | 7/1997 | Lee | 2/9 |
| 6,795,979 | B2 | * | 9/2004 | Fournier | 2/424 |
| 2001/0054188 | A1 | * | 12/2001 | Guay et al. | 2/6.4 |
| 2002/0108168 | A1 | * | 8/2002 | Roy et al. | 2/411 |
| 2007/0011797 | A1 | * | 1/2007 | Ikeda | 2/424 |

* cited by examiner

*Primary Examiner*—Katherine Moran
*Assistant Examiner*—Richale L Quinn
(74) *Attorney, Agent, or Firm*—Ralph D. Chabot

(57) ABSTRACT

The present invention is a ski helmet that combines a visor and face shield. Adapted to the ski helmet is a suitably thick strip of resilient foam material positioned across the exterior front-facing surface of the helmet protecting the forehead area of the person wearing the helmet. The face shield can be rotated to various positions which will change the contact area of the face shield and foam strip and thus the amount of air flow between the face shield and user's face. When the face shield is in maximum contact with the foam strip, air flow is minimized.

7 Claims, 2 Drawing Sheets

FIG. 1
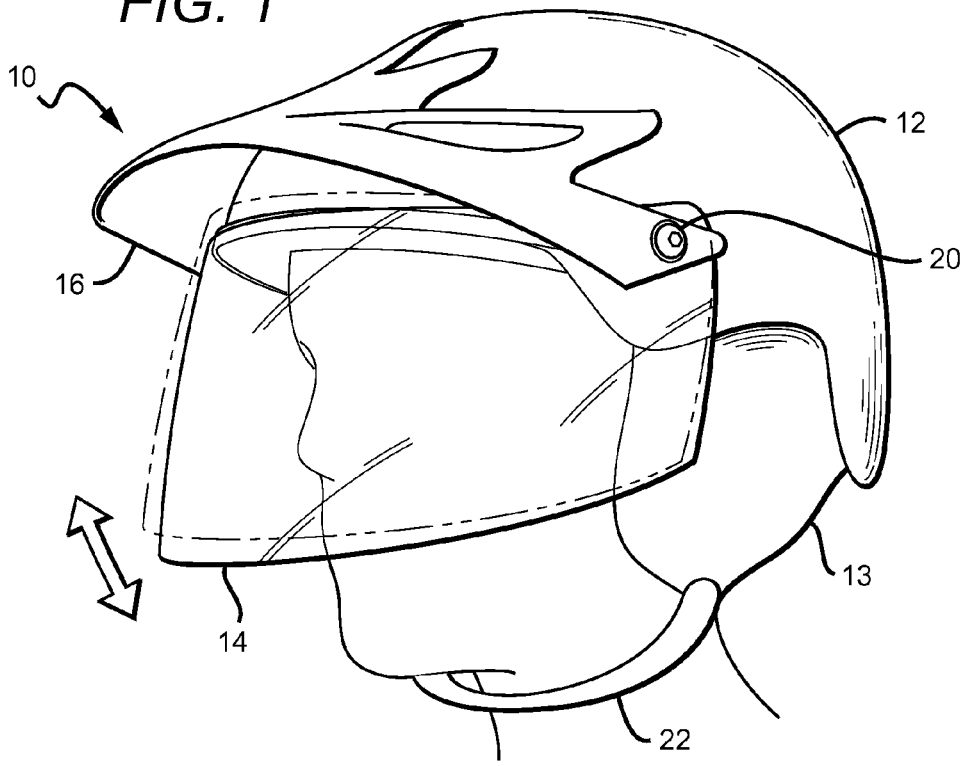
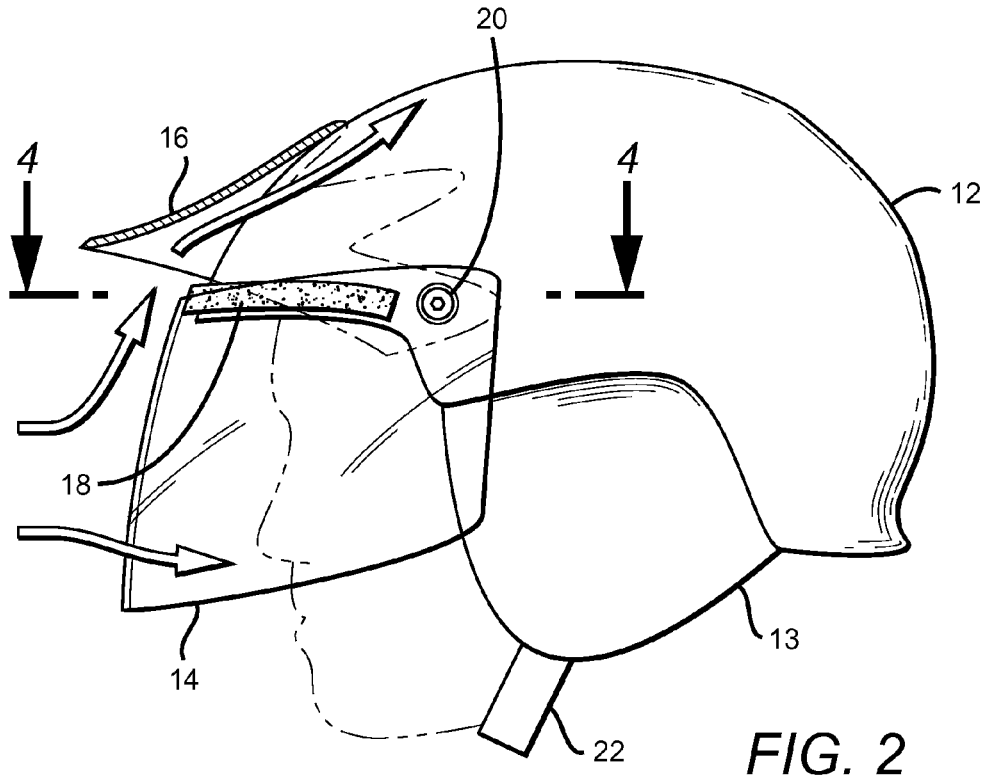
FIG. 2

SKI HELMET WITH ADJUSTABLE FACE SHIELD

PRIORITY CLAIM

This application claims the benefit of U.S. Provisional Application bearing Ser. No. 60/908,224 filed Mar. 27, 2007, the content of which is hereby incorporated by reference herein in its entirety for all purposes.

BACKGROUND OF THE INVENTION

This invention generally relates to helmets and more specifically to a helmet worn by snow boarders or skiers. Skiers have used helmets for protection against head injuries. Skiers have also used goggles or face shields for protection of the eyes and face not only in the event of a fall, but also against wind velocity when skiing at high speed.

A problem in using this sort of protective wear is that the interior surface of a face shield or goggles tend to fog as a result of the humidity and temperature difference between a person's face during a physical activity and outdoor winter conditions. Also, due to the close proximity of the worn goggles to the face, aerodynamic conditions are less than optimal which substantially reduces visibility in blizzard conditions.

One prior art example of a helmet with defogging capability is U.S. Pat. No. 4,612,675 issued to Broersma. This helmet was designed for motorcyclists and bicyclists and creates a frontward facing air inlet means by partially raising the faceshield which permits airflow circulation to different portions of the interior of the helmet. The Broersma reference is designed with a lower front wall structure to protect the chin and jaw area; essentially protecting the entire head from the neck up.

SUMMARY OF THE INVENTION

It is a major object of the invention to provide a helmet which is sufficiently light-weight to be worn by skiers and snowboarders and provide a means to prevent or eliminate fogging during activity.

The ski helmet comprises a helmet body, a visor and a face shield. In this specification, ski helmet is defined as the helmet gear worn by both skiers and snow boarders.

My invention incorporates an adjustable airflow means for controlling the airflow behind the face shield while skiing downhill. The adjustable airflow means has: a) a fully closed position where substantially no space exists between the top edge portion of the face shield and the adjacent helmet body; b) a fully open position where a maximum space exists between the top edge portion of the face shield and helmet body; and, c) at least one intermediate position between the fully open and closed positions where the space existing between the top edge portion of the face shield and the adjacent helmet body is less than the space of the fully open position and greater than the space present in the fully closed position.

The face shield and helmet are designed to properly function according to their respective physical dimensions. Specifically, the curvature of the face shield and the curvature of the top front face of the helmet body compliment one another so the face shield will open and close properly.

The ski helmet of the present invention does not incorporate a lower front wall structure as described in the Broersma reference. Accordingly, there is no helmet portion below the bottom edge of the face shield. Air flow is thus controlled not at the bottom portion of the face shield, but rather at its top portion which is adjacent to the top front surface of the helmet body that generally covers a user's forehead.

The adjustable airflow means can take many different embodiments.

In a first and most preferred embodiment, the adjustable airflow means includes the use of a suitably thick strip of resilient foam material positioned across the exterior top front surface of the helmet body using an adhesive or other suitable bonding material. The top front surface can be defined as that exterior surface area of the helmet body located below the visor and generally above the face shield which is the area that generally protects a user's forehead. This foam strip is preferably no more than ½" wide and runs along the exterior top front surface of the helmet. Alternative materials to a resilient foam can include a suitable rubber material or other resilient material which can exhibit the same performance characteristics.

In a second embodiment, the adjustable airflow means incorporates a tapered design for the front face portion of the helmet body which is designed to operably function with the face shield design. In other words, in the fully closed position, the top portion of the face shield is in contact with the front surface portion of the helmet body so substantially no space or gap exists which would permit any appreciable air flow behind the face shield. However, as the face shield is displaced or rotated upward, a gap or air space will be created and become larger relative to upward displacement. The helmet body design will accordingly be tapered to permit the user to control the magnitude of the gap.

In a third embodiment, the adjustable airflow means can incorporate a tapered design of the face shield and work in the same manner as the second embodiment described above. Since the face shield is only rotated upwards no more than about 2 centimeters, the taper is limited to the uppermost portion of the face shield so as not to interfere with a wearer's visibility.

The present invention is distinguished from the Broersma reference in that the lower edge of the face shield, when in the closed position described in Broersma is in contact with the lower front wall structure of the helmet and thus provides a seal against airflow behind the face shield. By contrast, the present invention has no lower front wall structure to assist in restricting air flow.

As mentioned earlier, airflow is not controlled by sealing the lower edge of the face shield. Rather, airflow is controlled by the sealing means between the face shield and the top front surface of the helmet body.

The visor and face shield are operatively attached to the helmet. In the preferred embodiment, the face shield has an aperture on either side having a common axis of symmetry with a respective threaded hole in the helmet. The face shield is then attached by a pair of screws which can be the same screws used to secure the visor to the helmet. At either of the attachment points, the configuration is screw-head/visor/face-shield/helmet. The preferred configuration allows the face shield to partially rotate upward or downward a few millimeters while the visor is fixed in position.

When the face shield is in a closed position, the portion of the face shield adjacent to its top edge is in substantial contact with the foam strip. The closed position prevents or minimizes air flow between the interior surface of the face shield and a skier's face while skiing.

The face shield, from the closed position, can partially rotate upward until contacting the visor or some other means for restricting rotational movement such as at least one post appropriately sized and positioned extending upward the exterior surface of the helmet. In this full open position, a significant portion of the foam strip is not in contact with the top edge of the face shield while a portion of the top edge is in contact with the visor or restriction means. Thus, a maximum rate of air can flow behind the face shield can be obtained while skiing. Additionally, the full open position refers to the position for allowing the maximum airflow rate.

For the preferred embodiment, it is to be understood that even in the full open position, the face shield continues to cover the person's face, thus continuing to protect the skier's face from flying debris, snow, contact with tree limbs, etc.

Because different skiing conditions typically require different lenses i.e. clear, polarized, contrast enhancing for optimal skiing enjoyment, etc. as is well known in the art, face shields can be manufactured for each type of skiing condition and can be designed to be interchangeable with my helmet.

The face shield is also designed to be positioned a sufficient distance away from a skier's face so that the space between can accommodate the skier wearing prescription glasses, if desired. Alternatively, the face shield can include a vision prescription, thereby eliminating the need for glasses while skiing.

Because of the frictional engagement of the screws holding the face shield to the helmet, the skier can also adjust the position of the face shield to any position between the closed position and the full open position to obtain the desired amount of airflow behind the face shield.

As the face shield is rotated to different positions between closed and full open positions, the contact area between the foam strip and the top edge of the face shield will change thus adjusting the available rate of air flow.

DESCRIPTION OF THE DRAWINGS

FIG. 1 is a perspective view of one embodiment of my ski helmet.

FIG. 2 is a side view of one embodiment of my ski helmet showing air flow across the face shield in a closed position.

DETAILED DESCRIPTION OF THE PREFERRED EMBODIMENT

Figure 3:
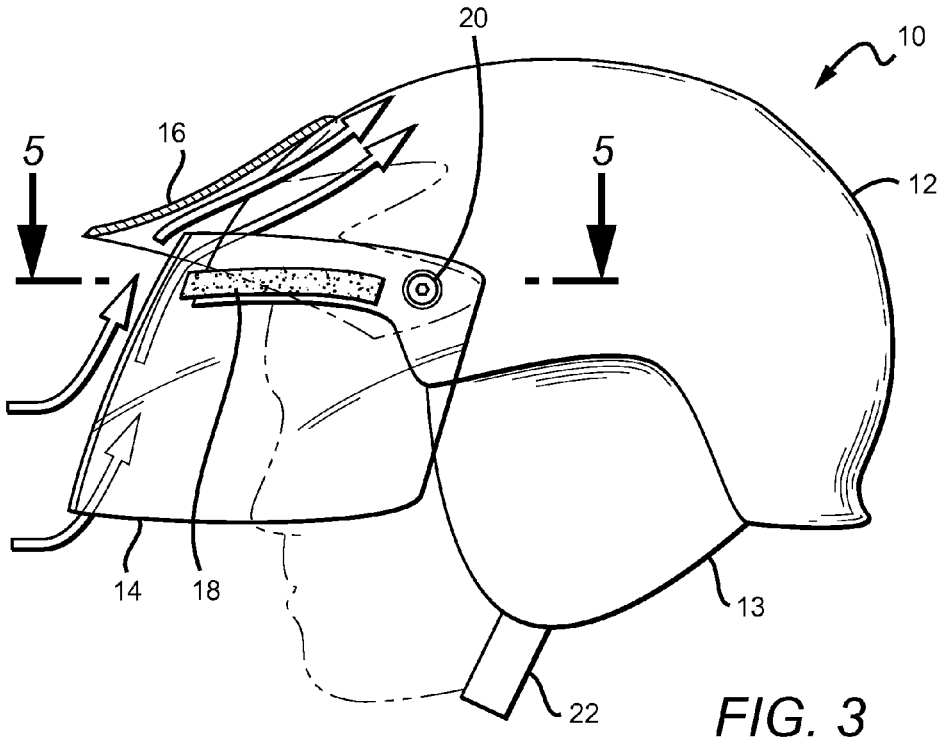
FIG. 3 is a side view of one embodiment of my ski helmet showing air flow across the face shield in a non-closed position.

My improved helmet 10 is shown in FIG. 1. Helmet 10 comprises helmet body 12, face shield 14 operatively connected thereto, visor 16, ear protection portion 13, and strap 22. A means is provided across the top front surface of helmet body 12 in an area substantially below visor 16 for preventing airflow behind face shield 14 while helmet 10 is worn during downhill activity. In the preferred embodiment, this means is a suitably thick strip of foam material 18. For illustrative purposes, foam strip 18 is not shown in FIG. 1.

As can be seen in FIG. 1, face shield 14 is pivotally connected at right and left side pivot locations 20 which are preferably screws. Face shield 14 can be rotated upward or downward about screws 20 which operatively attach face shield 14 to helmet body 12. In the fully downward or closed position represented in FIG. 2, the top edge portion of face shield 14 is in substantial contact with foam strip 18. Foam strip 18 must be sufficiently thick to contact both face shield and helmet body when face shield 18 is in the closed position yet must not be excessively thick so as to prevent face shield 18 from being rotated upward.

Figure 4:
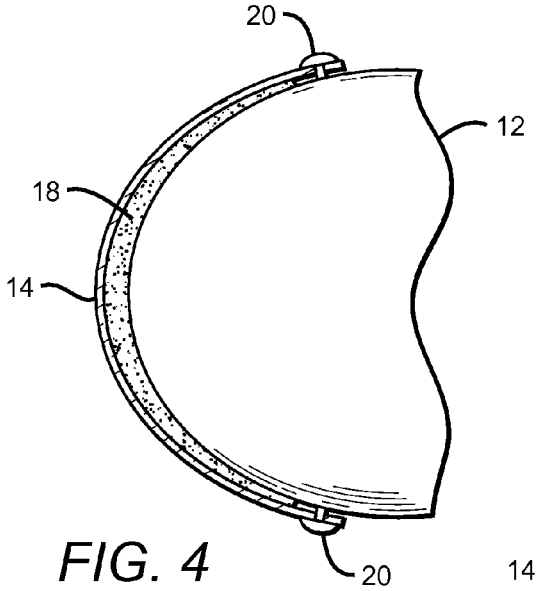
FIG. 4 is taken along view 4-4 of FIG. 2 and illustrates the contact area relationship of the face shield to the foam strip when the face shield is in the closed position.

FIG. 4 offers a cross sectional view further illustrating the seal provided by foam strip 18 to helmet body 12 and face shield 14 when in the closed position. For the closed position depicted in FIG. 2, airflow while a person wearing helmet 10 is skiing is depicted by arrows. Although the lower portion of face shield 14 is not contacting any surface, airflow behind face shield 14 is substantially non-existent due to the seal formed by foam strip 18.

Figure 5:
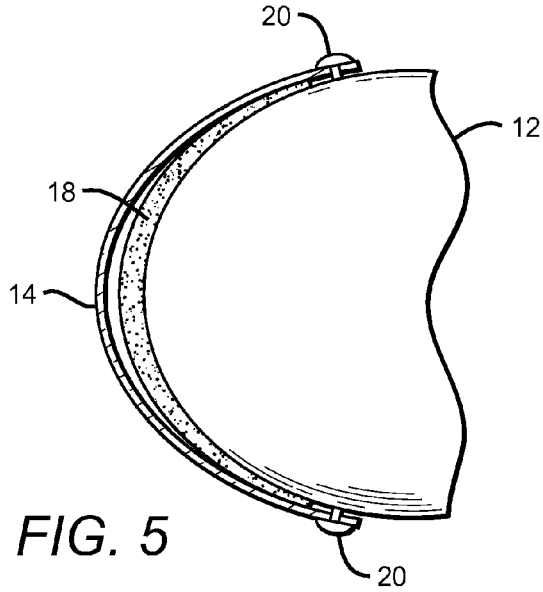
FIG. 5 is taken along view 5-5 of FIG. 3 and illustrates a non-closed position relationship between face shield and the foam strip.

When face shield 14 is in a position other than the closed position, a space is present between foam strip 18 and the adjacent surface of face shield 14 which permits airflow through said space. FIG. 5 depicts the space formed between face shield 14 and foam strip 18 when the face shield is raised as shown in FIG. 3. Airflow represented by arrows now occurs across the backside of face shield 14. This airflow provides cooling to the wearer as well as providing an anti-fogging or de-fogging characteristic.

Because of the helmet design, face shield 14 can be displaced or rotated upward from the fully closed position only a few millimeters to the fully open position which is the position of face shield 14 contacting the bottom portion of visor 16.

It is to be understood that in the fully open position, foam strip 18 may or may not contact face shield 14 in some area. The fully open position is simply the maximum rotational displacement of face shield 14 from the fully closed position which corresponds to the maximum space created between face shield 14 and foam strip 18.

The intended purpose of my helmet is to provide a defogging quality while utilizing the face shield to protect a wearer's face. The face shield need only be rotated a few millimeters to create a sufficient space between foam strip 18 and face shield 14 in order to attain sufficient airflow behind face shield 14 necessary to prevent fogging. Accordingly, visor 16 is operatively positioned across the top portion of helmet body 12 such that face shield 14 can only be raised a few millimeters before contacting visor 16, thus eliminating any further upward movement of face shield 14.

I claim:

1. A ski helmet having a helmet body, a fixed positioned non-rotatable visor attached thereto, the helmet body having a top front surface located below the visor, the helmet body further having no lower front wall structure, the improvement comprising:

a resilient foam strip of sufficient length, width and depth, said foam strip operatively attached to the top front surface of the helmet body;

a face shield having a top edge portion, said face shield rotatably attached to the helmet body, said face shield rotatable from a closed position where said top edge portion substantially contacts said foam strip, upward to a fully open position where a significant portion of said foam strip is not in contact with said top edge portion and contacts a means for restricting further upward rotational movement.

2. The helmet of claim 1 where said means for restricting rotational movement is the visor.

3. The helmet of claim 1 where said means for restricting rotational movement is at least one post appropriately sized and positioned extending upward from the exterior surface of the top front surface of the helmet.

4. The helmet of claim 1 where said rotatable attachment of said face shield to said helmet body comprises a pair of threaded holes, in said helmet body; and a pair of apertures in said face shield located on opposing sides of said face shield and positioned to have a common axis of symmetry with said threaded holes, and a screw threadably engaging each respective threaded hole to rotatably mount said face shield to said helmet body.

5. A ski helmet having a helmet body with no lower front wall structure, and a rotatable face shield having an inner surface in which airflow traveling across the inner surface of the face shield can be adjusted comprising:

a helmet body, a fixed positioned visor attached thereto, said helmet body having a top front surface located below the visor, said helmet body further having no lower front wall structure;

a face shield having a top edge portion, said face shield rotatably attached to the helmet body;

an adjustable airflow means comprising: a resilient foam strip of sufficient length, width and depth, said foam strip operatively attached to said top front surface of the helmet body; and the rotational movement of said face shield from a closed position where said top edge portion substantially contacts said foam strip which substantially eliminates airflow traveling across the inner surface of the face shield, upward to a fully open position where a significant portion of said foam strip is not in contact with said top edge portion which maximizes airflow traveling across the inner surface of the face shield; and;

a means for restricting further upward rotational movement of the face shield past said fully open position.

6. The helmet of claim 5 where said means for restricting further upward rotational movement is a visor mounted to the top of said helmet body.

7. The helmet of claim 5 where said means for restricting further upward rotational movement is at least one post appropriately sized and positioned extending upward from the exterior surface of the top front surface of said helmet body.

* * * * *